US005249689A

United States Patent [19]

Wergeland et al.

[11] Patent Number: 5,249,689

[45] Date of Patent: Oct. 5, 1993

[54] HANDLING AND COMPACTING OF EMPTY BEVERAGE CANS

[75] Inventors: Halvor Wergeland, Asker; Tore Planke, Nykirke, both of Norway; Tommy Wincent, Upplands Väsby, Sweden

[73] Assignee: Tomra Systems A/S, Asker, Norway

[21] Appl. No.: 927,826

[22] Filed: Aug. 10, 1992

Related U.S. Application Data

[62] Division of Ser. No. 699,175, May 13, 1991, abandoned.

[51] Int. Cl.[5] ..... B07C 5/00; B30B 9/00

[52] U.S. Cl. ..... 209/546; 209/523; 209/552; 209/646; 209/650; 100/91; 100/902

[58] Field of Search ..... 209/522, 523, 525, 546, 209/552, 645, 646, 650; 100/91, 902

[56] References Cited

U.S. PATENT DOCUMENTS

| | | | |
|---|---|---|---|
| 1,556,048 | 10/1925 | Thompson | 209/645 X |
| 2,339,638 | 1/1944 | Henszey et al. | 209/552 |
| 2,354,628 | 7/1944 | Whitesell, Jr. | 209/546 X |
| 2,822,088 | 2/1958 | Beaumont et al. | 209/546 |
| 3,916,780 | 11/1975 | Heiser . | |
| 4,291,618 | 9/1981 | Heiser et al. | 100/902 X |
| 4,412,608 | 11/1983 | Kaspar et al. . | |
| 4,532,859 | 8/1985 | Solardal | 100/902 X |
| 4,542,689 | 9/1985 | Trolle | 100/902 X |

FOREIGN PATENT DOCUMENTS

| | | | |
|---|---|---|---|
| 2557332 | 6/1985 | France . | |
| 59-107799 | 6/1984 | Japan . | |
| 0321099 | 12/1989 | Japan | 100/91 |
| WO8102802 | 10/1981 | PCT Int'l Appl. . | |
| 9005346 | 5/1990 | PCT Int'l Appl. | 100/902 |
| 420135 | 9/1981 | Sweden . | |
| 457673 | 1/1989 | Sweden . | |

*Primary Examiner*—Joseph E. Valenza
*Assistant Examiner*—Tuan N. Nguyen
*Attorney, Agent, or Firm*—Rodman & Rodman

[57] ABSTRACT

A system for identification, separation and compacting of empty beverage cans including a first device for distinguishing between cans to be accepted and not accepted and rejecting non-acceptable cans, and for detecting at least one dimension of a can to be compacted, and for determining a can redemption value based on such detection, and a second device for compacting the can through interaction of a three arm device, a first arm contacting a mid-portion of the can and compressing that mid portion, and second and third arms acting on end regions on either side of the mid-portion to compress the remaining portions of the can. The arm device is retracted and the compacted can is removed after the compressing action is completed by the arm device.

19 Claims, 8 Drawing Sheets

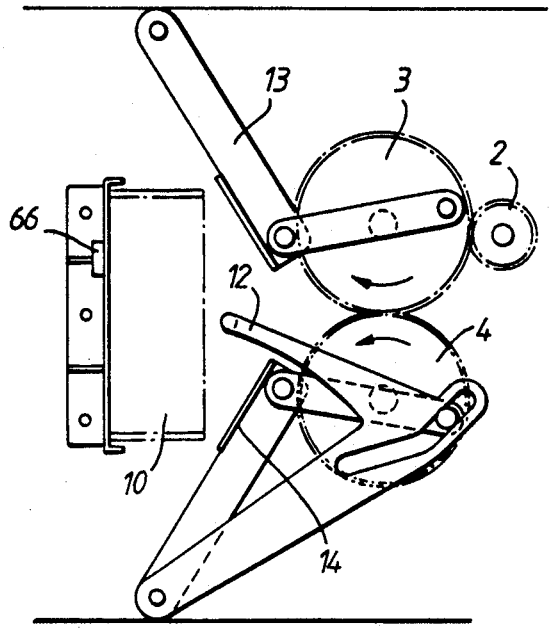
Fig.2.
Fig.3.
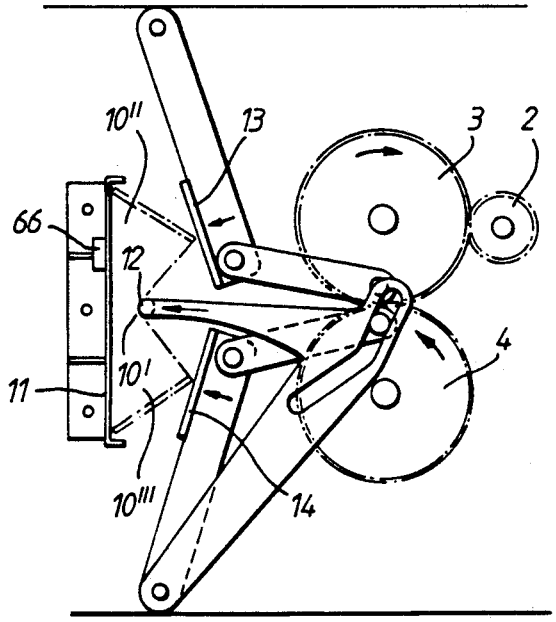
Fig.4.
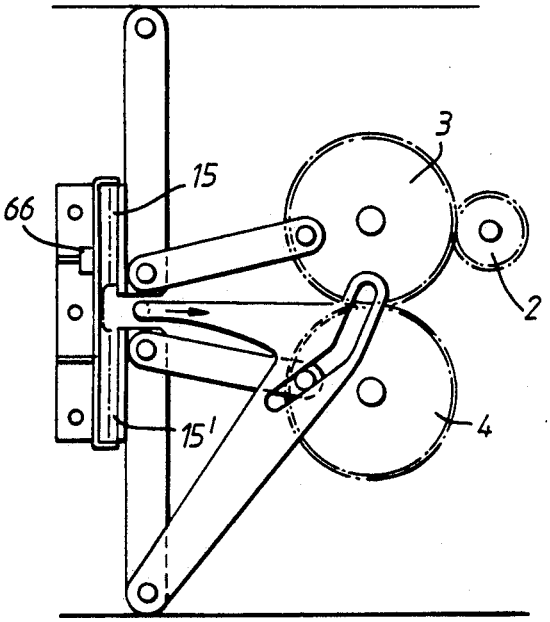

HANDLING AND COMPACTING OF EMPTY BEVERAGE CANS

This is a division, of application Ser. No. 699,175; filed May 13, 1991, now abandoned.

The present invention relates to a method and device for compacting empty beverage cans. Further, the invention relates to a device for identification and separation of beverage cans. Still further, the invention relates to a system for handling and compacting empty beverage cans to be recycled.

Although such cans in most cases are of metal, e.g. aluminium or steel, they could instead e.g. be of a plastic material. Thus, type of can material is not to be construed as limitative to the present invention.

A device for compacting empty beverage cans of metal is inter alia of a type where a can is squeezed between a smooth wall and movable chain means with decreasing space between said wall and chain means. Such prior device requires a high power and creates a lot of noise.

It is therefore an object of the present invention to provide a method and device for compacting empty beverage cans of metal requiring minimum of power and yielding a noise level which is much lower than with prior art devices.

A device for identification and separation of beverage cans of metal is inter alia known from U.S. Pat. No. 4,532,859.

The present invention provides, however, a functionally somewhat simpler device for identification and separation of beverage cans, and which is able to operate on a continuous basis unless a non-acceptable can is received. In a system for handling and compacting empty beverage cans of metal to be recycled, it would be possible to use an apparatus according to U.S. Pat. No. 4,532,859, although the present inventive device for identification and separation of beverage cans is preferred. According to the invention the method for compacting empty beverage cans comprises the steps of forwarding the can to an operation site of a compacting device, arranging the can to be substantially parallel to a can abutment surface of said device, subjecting the can to a first compacting step by means of a first pressure force acting in a transverse direction of said surface for compressing a midsection of said can, subjecting end regions of the can to second and third pressure forces, respectively, acting in the direction of said surface, to cause the end faces of said can to lie substantially parallel to said surface, removing the can so compacted from said site, and collecting the compacted can.

Preferably the can is prior to the forwarding to an operation site subjected to a type-of-material detection and the said steps are executed if a single material of a type to be recycled is detected. Conversely, if a material of type not to be recycled or undesirable types of materials are detected through said metal detection, then the non-compacted can is returned to a can return site.

The device for compacting empty beverage cans comprises electric motor means, gear means connected to an output shaft of said electric motor means, means for receiving said can from a can delivering device, and locating said received can at an operation site, means providing an abutment surface for said can at said site, a first arm means movable across said site towards said surface to compress a mid-section of said can against said surface, second and third arm means movable across said site towards said surface to compress end regions, respectively, of said can, against said surface, causing the can end faces to lie substantially parallel to said surface, gear means providing a synchronized movement of said second and third arm means towards and away from said surface, and movement of said first arm means related to the movement of the second and third arm means, and reciprocally operative means for removing a trap door means at said site upon a retraction movement of said arm means away from said surface to establish an exit hole for said can to fall through, and causing said trap door means to close said hole after the passing of said can through said hole.

The device for identification and separation of beverage cans comprises: a first can output, a second can output, means at said can input for sensing the type or types of material of said can, electric motor means, a rotary can supporting means having its axis of rotation horizontal and capable of turning in at least one direction through 360° by means of said electric motor means, said rotary can supporting means having cradle means for receiving a can at said input and retaining said can therein until delivered at the first or second can output, logic processing means capable of controlling the direction of rotation of said motor means based on an output signal from said sensing means to transfer said can either to said first can output or to said second can output, said first can output being below said can input for returning cans being of a type not to be accepted, and said second can output being located approximately 180° relative to said can input and above an operation site for compacting of said can for subsequent processing thereof.

The system for handling and compacting empty beverage cans to be recycled comprises a first device having means for distinguishing between cans to be recycled and not recycled and rejecting non-recycleable cans, and having means for detecting at least one dimension of a can to be compacted and means for determining a can redemption value based on such detection, and a second device for compacting said can through the interaction of three arm means, a first of said arm means contacting a mid-portion of said can and compressing that mid-portion, and second and third of said arm means acting on end regions on either side of said mid-portion to compress the remaining portions of said can, and means for removing said compacted can when said arm means retract after their respective compression action.

Further features characterizing the embodiments of the present invention will appear from the following claims as well as from the description below with reference to the attached drawing figures illustrating preferred, but non-limitative embodiments of the invention.

FIGS. 2, 3 and 4 illustrates steps in the process of compressing a beverage can, according to the invention.

Figure 1:
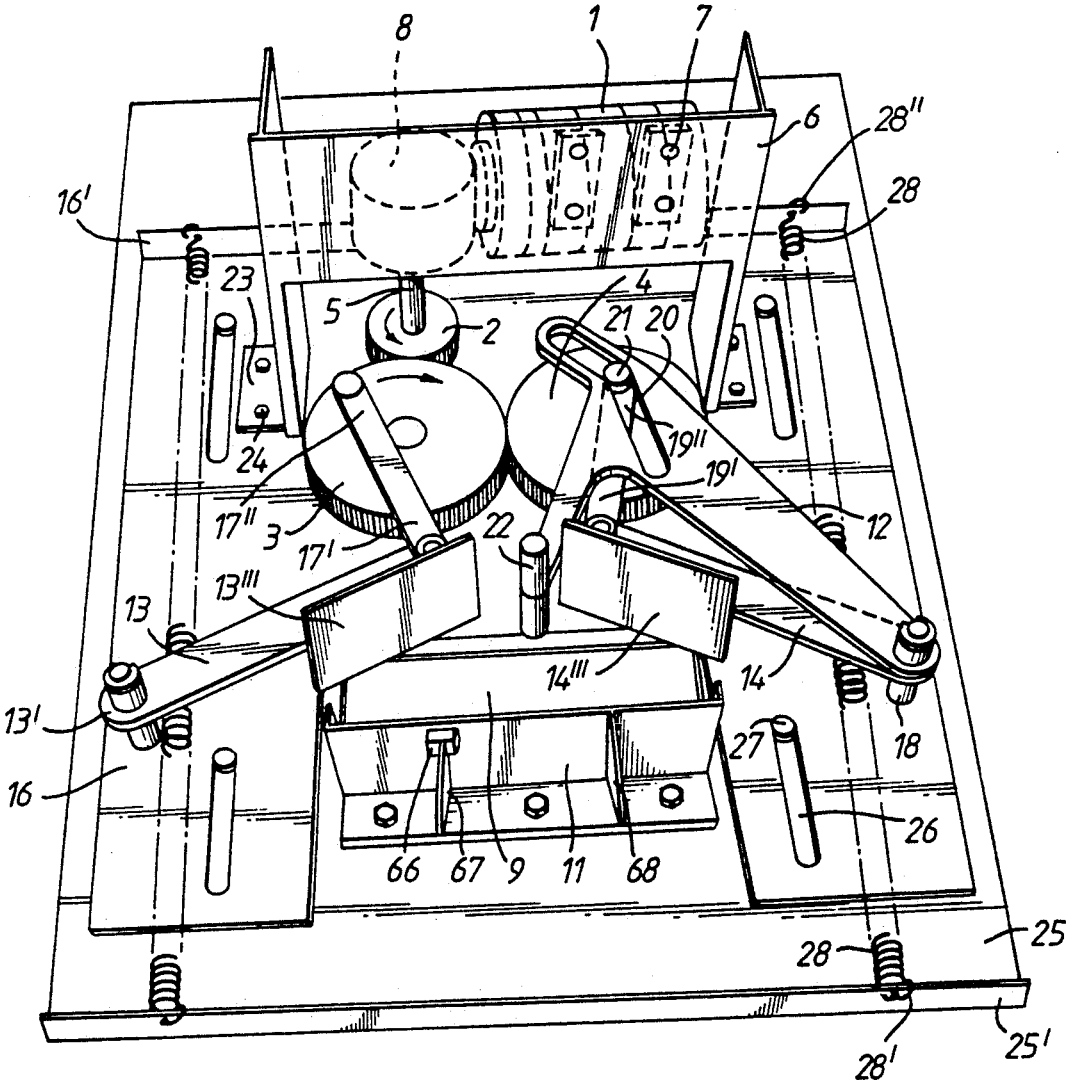
FIG. 1 is a perspective view of a compacting device according to the present invention.
Figure 5:
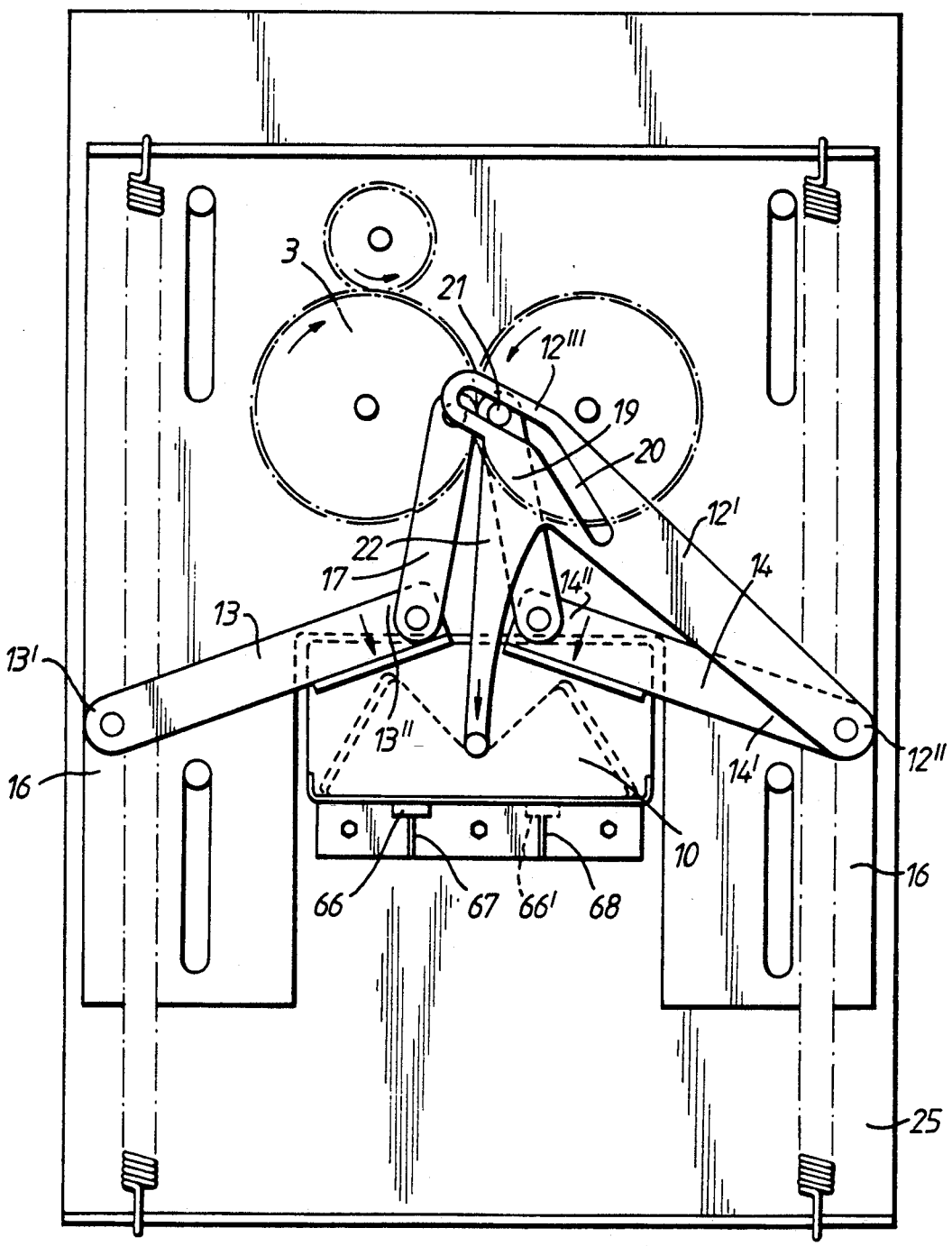
FIG. 5 is a plan view of the compacting device illustrated in FIG. 1, and without motor drive indicated.

A can compacting device, according to the invention is illustrated in FIG. 1 as well as in FIG. 5 and with the principles of operation illustrated in FIGS. 2, 3 and 4.

The device for compacting empty beverage cans, e.g. of metal, comprises an electric motor means 1 with gear means 2, 3, 4 coacting with an output shaft 5 of said electric motor means 1. Said motor means is suitably connected to a stand 6 by means of bolts 7. Suitably the shaft 5 is connected with the motor 1 via a rotary link or gear 8. When a can is delivered to said device from a can delivering device (not illustrated on FIGS. 1-5, but to be explained later), said can is positioned at an operation site 9, the can being indicated in FIGS. 2-5 by reference numeral 10. An abutment surface 11 at said operation site provides a countermember when the can is subjected to compression.

A first arm means 12 is moveable across the operation site towards the member 11 to compress a midsection 10' of said can against the member 11, as clearly illustrated in FIG. 3. Thus, it is noted that the can is initially compressed at a midsection thereof, which is structurally the weakest portion of the can when a force acts transversely of the can surface. Thus, the first arm means provides the initial compressing of the can 10 whereafter completion of the compression or compacting of the can is provided by means of second and third arm means 13 and 14, respectively. Said second and third arm means are moveable across the operation site against said member 11 to compress the end regions 10'', 10''', respectively of the can 10, as clearly illustrated in FIG. 3. Upon the completion of the movement of said second and third arm means 13, 14 the end members 15, 15' of the can 10 will lie substantially parallel to the member 11, as clearly illustrated in FIG. 4.

The gear means 2, 3, 4 provide a synchronized movement of the second and third arm means 13, 14 towards and away from the member 11, and movement of the first arm means 12 is related to the movement of the second and third arm means. Suitably the first gear has a first radius and the second and third gears 3, 4 have a second larger radius. The first gear is connected to the output shaft 5 from the electric motor, and the second and third gears 3, 4 rotate at the same velocity and in opposite directions.

The second arm means 13 is at its one end 13' hinge connected to a support means 16 and at its other end 13'' pivotally connected to a first end 17' of a first link means 17, said first link means 17 at its other end 17'' being pivotally connected to the second gear 3 at a peripheral location thereof. The third arm means 14 is at its one end 14' hinge connected to said support 16. The said hinge connections to the support could be in the form of a stud 18 protruding up from said support means 16 and pivotally engaging said respective arm means. At its other end 14'' the third arm means 14 is pivotally connected to a first end 19' of a second link means 19, said second link means at its other end 19'' being pivotally connected to said third gear 4 at a peripheral location thereof.

As clearly noted from FIGS. 1-5 the first arm means is of an angled two-legged configuration, substantially of V, U or L shape, one leg 12' thereof at its free end 12'' being pivotally connected to said support means 16 via said stud 18 or its equivalent, and at its other end region 12''' being provided with slot means 20 interacting with slide means 21 located at said peripheral location of said third gear means, and the other leg 22 of said first arm means extending from and the other leg 22 of said first arm means extending from said other end region 12''' of the first arm means in the direction towards the previously mentioned abutment surface or member 11. Thus, the movement of the arm means 13 is controlled by the movements of the link means 17 and the second gear means 3. The movement of the arm means 14 is controlled by the movements of the link means 19 and the third gear means 4. Finally, the movement of the first arm means 12 is controlled by the movement of the third gear means 4 and the interaction between the slot means 20 and the slide means 21. As noted on FIG. 1, first, second and third arm means 12, 13, 14 have each an engagement means 22, 13''', 14''', respectively, for physically contacting the can upon the compacting thereof. The overall surface area of said engagement means for contacting the can is substantially equal to a longitudinal cross section of a non-compacted can.

The stand 6 is connected to the support means 16 by means of brackets 23 and bolts 24. The abutment surface or counteracting member 11 is not attached to the support means 16, but instead attached to a base means or table means 25 below said support means 16. Said support means 16 is slideably connected to the base or table means 25 by means of slots 26 in said support means and pins 27 engaging and slideably securing said support means 16 to said base or table means 25. Spring means 28 are at one end 28' attached to an upright edge 25' of the base or table means 25 and at its other end 28'' attached to an upright edge 16' of the support means 16. Thus, the springs 28 will tend to pull, under normal operation, the support means 16 in the direction of the upright edge 25'. The reason for the mutual slideability between the support means 16 and the base or table means 25 is a safety precaution in the event that a foreign body through accident enters the operation site and causes the compacting device to be jammed unless the spacing between the arm means 12, 13 and 14, and the member 11 is increased automatically. Such slideability also protects the gears 2,3,4 from overload, as well as functionally related elements thereto. Such an event could also be caused by e.g. an unopened, liquid filled can entering the operation site 9.

It should be readily understood that said springs 28 could easily be replaced by any suitably resilient member means to force the base means 16 towards the edge 25', such resilient members means yielding in the event of a foreign body to increase the said space between said arm means 12, 13 and 14 and the member 11, as explained above.

A pressure detector 66 is suitably located behind the member 11 and between a support bracket 67 therefor and said member 11, as more clearly illustrated in FIGS. 1, 5, 6, 7 and 13. Suitably, the pressure detector 66, is located to be operative with the action of the third arm means 13 compressing its corresponding part of the can against the member 11. Such pressure detector could instead or in addition be located at the support bracket 68, as shown by dotted line 66' to be operative with the action of the second arm means 12. However, in most cases such pressure detector 66 will be sensitive to compression in general of the can by the first, second and third arm means. Thus a positive detection of a can being compacted is provided by said pressure sensitive detector 66 (and/or 66'). Thus the compacting device is made substantially pilfer-proof when operating in a redemption-system because no redemption evaluation is provided until the compacted can has left the opening 9' through the trap door means 29.

Figure 6:
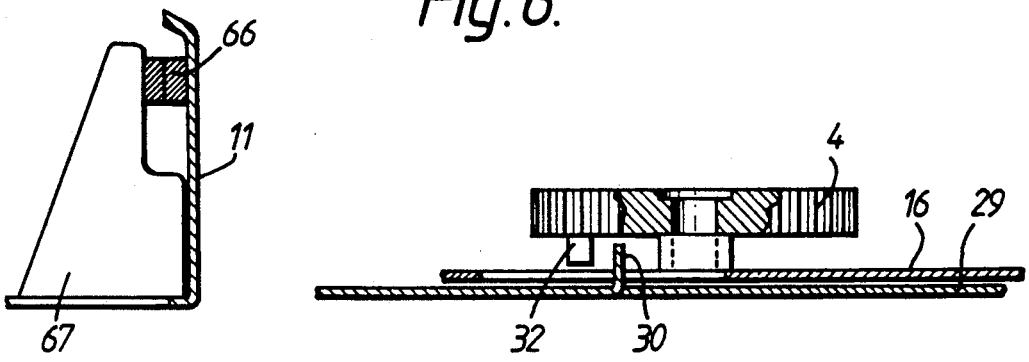
FIGS. 6 is a sectional view of FIG. 7 at section VI—VI therein, FIG. 7 illustrating means for moving a trap door means at a compacting site for said can in top view, with elements not related to said functioning of said trap door means removed for sake of clarity.
Figure 7:
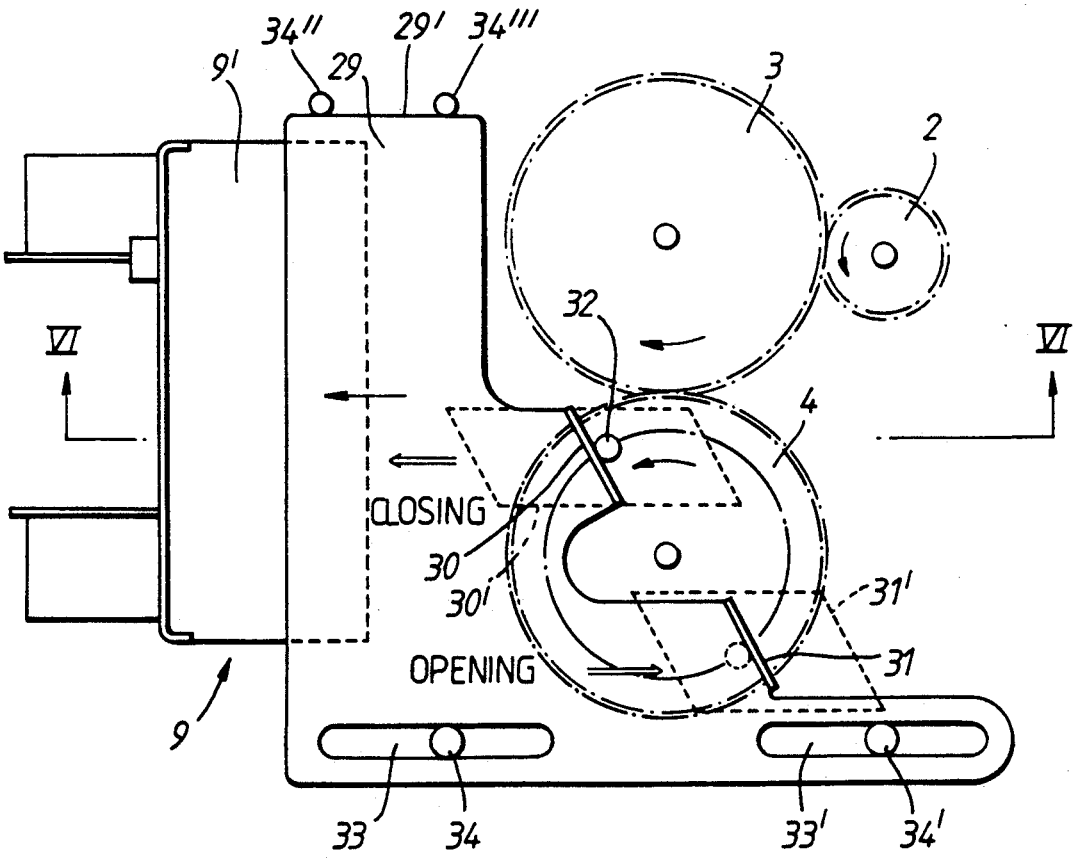

The operation site 9 for the compacting of the can has a trap door means 29. Before explaining the operation of the trap door means further, it should be noted, for sake of clarity, that the arm means, the link means, springs, the support means, the base or table means explained above have not been illustrated on FIG. 7 to simplify the understanding of the operation of the trap door means. In FIG. 6 the support means 16 is illustrated to show how the trap door means is arranged relative thereto, i.e. on the bottom side of the support means 16. Openings 30' and 31' to be explained more fully below are thus located in the support means 16. The base or table means 25 is so designed that it does not in any way interfere with the operation of the trap door means 29. Thus, the pins 27 could serve also as spacer members between the support means 16 and the base 25, or the base 25 could have a cut-out area in the operational region of the trap door means 29.

Said trap door means 29 has two cams 30 and 31. The cam 30 is used for closing the opening 9' of the operation site, and the cam 31 is used for moving the trap door 29 away from the operation site to leave the operation site with the opening 9' in order that the compressed or compacted can may fall through such opening 9'. No spring means are required to interact with the operation of the trap door means 29. A pin 32 protruding down from the bottom side of the gear 4 is located to alternatively engage the cams 30 and 31. Thus, it is seen that the upright cams 31, 32 of which only cam 32 is seen in FIG. 6, are moveable in respective openings 30', 31' (not illustrated on FIGS. 1-5 for sake of clarity in the drawings) in the support means 16. In order to obtain a controlled slideability between the trap door means 29 and the support means 16 as well as the operation site 9, slots 33, 33' are provided in said trap door means 29 coacting with guide pins 34, 34', respectively. Also, guide pins 34'', 34''' are provided along edge 29' of the trap door means 29. Thus, it will be readily seen that the base or table means 25 does not interfere with the region governed by the trap door means 29.

As explained with reference to FIGS. 1-7, there is thus provided compacting means for compressing fully an empty beverage can using low power motor means 1 and providing low noise. Further, the device is compact and mechanically simple and requires little or no maintenance, yet is safe to operate and safe in the case of a foreign body or full can entering the space between the member 11 and the arm means 12, 13 and 14, in which case the unit assembled on the base means, including said trap door means 29, will move away from the member 11, thus creating an opening 9' through which the foreign body or full can can fall through.

Having thus described the present compacting device, there is now to be described a device according to the invention for the identification and separation of beverage cans to be compacted or not.

Said device for identification and separation comprises a can input 35, a first can output 36 and a second can output 37. A sensing means 38 is provided for sensing the type or types of material of the can. Such sensing device could be of inductive or capacitive type. A rotary can supporting means 39 is provided, designed more or less like a drum having its axis of rotation horizontal and being capable of turning in at least one direction through 360° by means of an electric motor 40. The rotary can supporting means has cradle means, in preferred embodiment in the form of two cradles 41 and 42 which are spaced 180° from each other. Logic processing means 43 are provided and connected to the said sensing means 38 and delivers output signal to the electric motor 40 for controlling direction of rotation of the drum 39 and the angle of rotation thereof. The direction of rotation of the motor 40 is based on an output signal from the sensing means 38 to transfer the can either to said first can output 36 or to the second can output 37. If the sensing means 38 detects that the can is made of undesired material or materials, the can should not be accepted and the drum 39 is turned, as viewed in FIG. 13, in a clockwise direction through approximately 90° to deliver the can from the cradle 41 into the first can output 36 to be collected by the person who entered the can into the rotary can supporting means 39. Also, the can is normally returned to the first can output if it contains any foreign matter, e.g. metal nails, which is considered to be a further type of material beyond that which the can itself is made of. Conventionally most beverage cans are made solely of aluminium or solely of steel, and it is desirable to recycle such empty beverage cans. If a recycleable one-material type of can is entered into a cradle 41 or 42 lying next to the can input 35, the drum 39 is turned by the motor 40 due to proper detection by the means 38 and 43 in an anti-clockwise direction towards the second can output 37 i.e. by turning the drum through approximately 180° in order to deliver the can 10 to an operation site of a compacting device, e.g. of the type disclosed in connection with the description of drawing FIGS. 1-7. The compacting device delivers the compacted can 10 to a collection bin 44.

The sensing device 38 is powered through line 45 and delivers signals back to the logic processing means through the same line 45. The electric motor 40 is powered through the logic means 43 via electric wires 46 and 47. Suitably the electric motor 40 could be a stepping motor, or the logic processing means could include a timing device in order to make sure that the electric motor rotates at least through 90° so that a rejectable can is in any circumstance returned to the first can output 36. The logic processing means is powered from a mains inlet 48 and the logic processing means is provided with DC voltages through a rectifier 49. AC power is also delivered to the electric motor means 1 as such electric motor means may be an inexpensive low power AC motor. Alternatively a DC motor could be used, in which case said electric motor means could be connected to the output of the rectifier 49.

Figure 13:
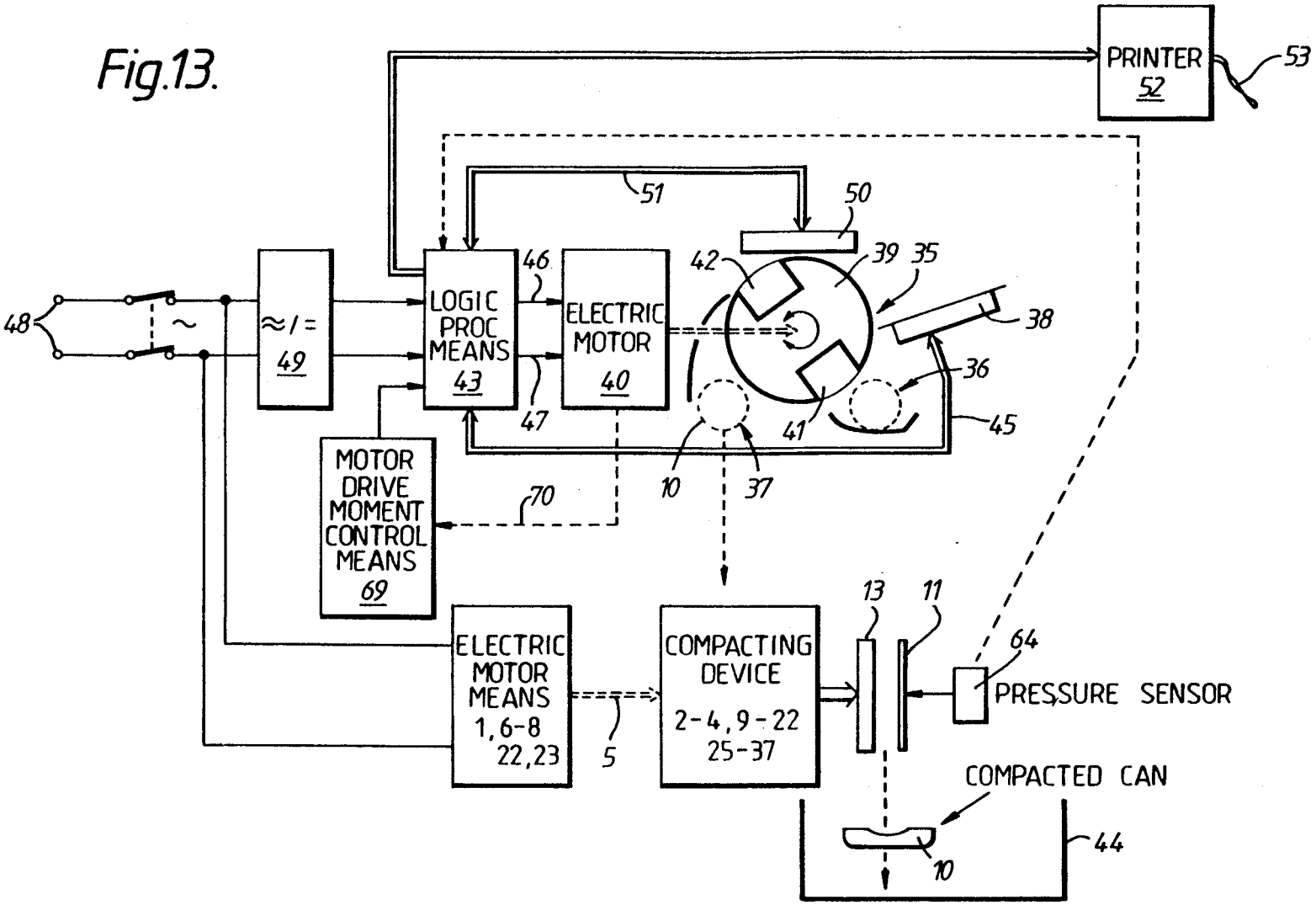
FIG. 13 is a principal schematic showing the overall system, according to the invention.

In order to determine the redemption value of a recycleable beverage can, a dimension sensing device 50 could be arranged above the drum 39 as schematically indicated in FIG. 13 in order to detect one or more dimensions of the can in the cradle, e.g. dimension such as length and width of a can. The sensing means 50 could be of any suitable type in order to detect such dimensions, e.g. mechanical cam members capable of riding on the surface of the can as it passes by the sensing means 50 on its rotation from the can input 35 to the second can output 37. Alternatively, the can dimension sensing means 50 could be an optical, capacitive or inductive detection device.

The sensing means 50 is linked to the processing means 43 through a line 51. In case the sensing device requires power, such power is delivered also through line 51 from the logic processing means 43.

Based on the input from the sensing means 50, the logic processing means 43 calculates a redemption value for the can 10 to be compacted based on the output signal from the sensing means 50 and prestored data in the logic processing means 43, and outputs a refund value to a printer 52, said printer providing a receipt 53 to be collected by a customer who has put the can into the rotary can supporting means 39. Alternatively or additionally, the sensing means 50 could be an image reading device capable of reading the imprints on a can, e.g. also a bar code, in order to exactly determine the type of can to be recycled and appropriate redemption value. To avoid any possibility of "cheating" the system, the container is not validated (redemption value) until after a positive detection of can-compaction is obtained from the pressure sensitive detector 66.

The device for identification and separation of beverage cans of metal as generally disclosed in connection with FIG. 13 is now to be more closely described in connection with a preferred embodiment of the invention as more fully illustrated in FIGS. 8–12. Some of the reference numerals in FIG. 13 are also found in FIGS. 8–12 and disclose same or equivalent elements.

Figure 8:
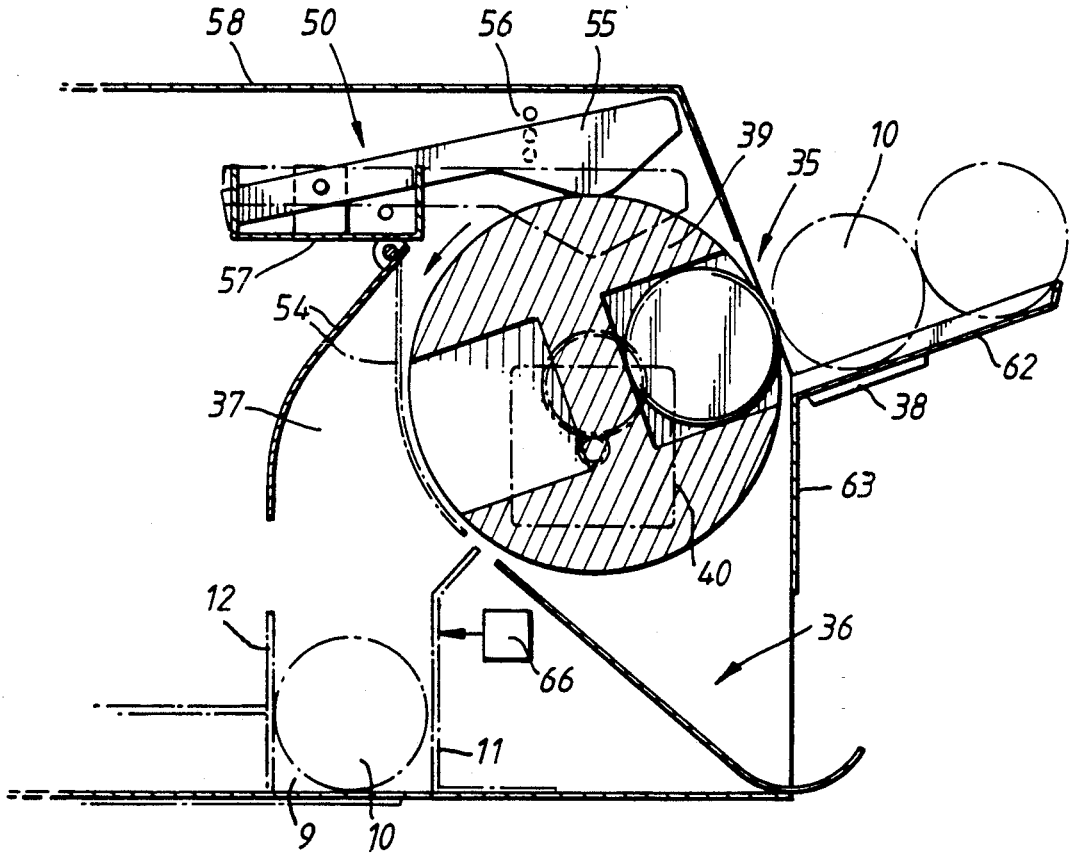
FIG. 8 represents a functional view of a device for identification and separation of beverage cans, according to the invention.
Figure 9:
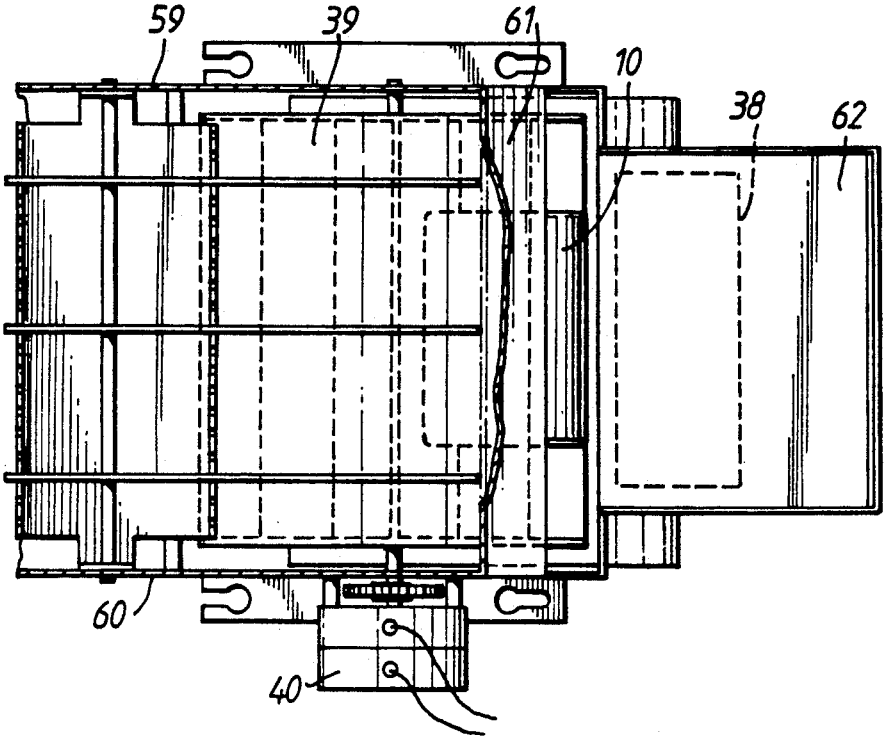
FIGS. 9 and 10 are top perspective views of the device of FIG. 8 in two different states of the device.
Figure 10:
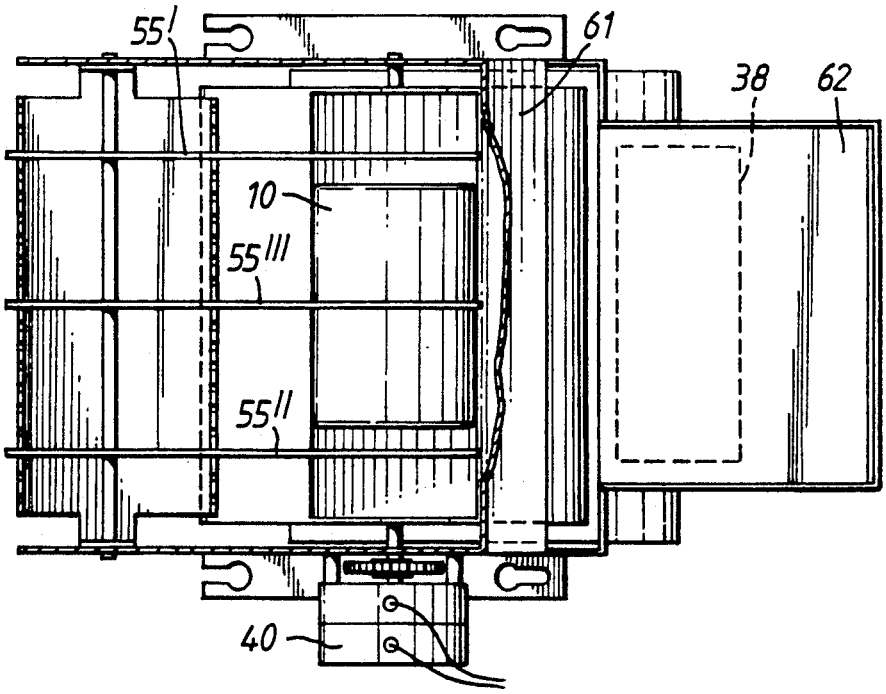

Suitably, the device of FIG. 8 is provided with a shield means 54 at the second can output, said shield causing the can to be directed right into the operation site 9 of the compacting device described earlier. The abutment surface or counteracting member 11 is also illustrated and a compacting action is illustrated with the first arm means 12 in an initial engagement with the can surface at a mid-portion of the can 10. If a can detected by the sensing means 38 is considered by the logic processing means not to be of the correct type, the rotary can supporting means 39 or drum is rotated in a clock-wise direction until the can drops out into the first can output 36. Under normal circumstances, the drum 39 will rotate in an anti-clockwise direction. Suitably, under normal operation, the drum 39 rotates continuously in the anti-clockwise direction collecting cans 10 at the input 35 and delivering cans at the output 37 on a continuous basis at fixed intervals. In a simple version of the sensing means 50 said means could be constituted by cam members 55 capable of riding on the drum, as shown in FIG. 8, and on the can surface as the can passes the cam members 55. By using a number of cam members 55, e.g. as illustrated in FIGS. 9 and 10, it is possible both to measure the length and width (or cross sectional dimension) of the can lying in a cradle 41 or 42 in order to verify a correct can. In order to check the cross-sectional diameter of the can with reference to the cradle bottom, the can could be measured by means of detecting the angle of tilting of one of the cams, e.g. by using the shadow image of such cam and detecting that image by means of array of photodetectors 56. Alternatively or additionally, each cam could be connected to a micro-switch 57 in order to detect whether or not a cam has dropped in front and at the rear of a can lying in a cradle, e.g. as illustrated in FIG. 10 by the cam members 55' and 55''. The middle cam member 55''' is capable of riding on the surface of the can. In a preferred and simplified embodiment of the invention as disclosed in FIGS. 8–12 the said members 55 detect only the lengths of the can lying in the cradle 41 or 42. In FIGS. 9–12, a top lid member 58, as shown in FIG. 8, has been removed for sake of clarity. The device according to FIG. 8 has, as shown in FIGS. 9 and 10 side panels 59 and 60, upper front panel 61 and input tray 62 and a bottom front panel 63, see FIG. 8.

In order to avoid a liquid filled can or even an unopened can, or a can containing other foreign matter (even of same type of material as the can itself-so that it is not detected at the type-of-material detection) to enter the compacting device, it may be of advantage to provide the device for identification and separation of beverage cans with motor drive moment control means 69 detecting (via line 70) and/or controlling (via line 71) motor current of the motor means 40 driving the drum 39.

As readily appreciated, the weight of the can will have a bearing on the overall motor moment of the motor 40 (idle moment plus added moment due to loading of can in drum).

Thus, the motor current will be a function of the weight of the can located in the drum. Thus, if the sensor means 69 senses a motor current above a set threshold, it may cause the motor to release its retaining moment of force, so that the drum turns to the first can exit 36 to exit the non-acceptable can. Alternatively, the sensor means 69 may be set at a specific motor current, thus yielding a set motor moment. If the can is of such weight that the total moment exerted on the motor is greater than that provided by the set current, the motor means 40, suitably a stepping motor, will be caused to slip back until the too heavy can exits the drum at the first can output or exit 36.

Figure 11:
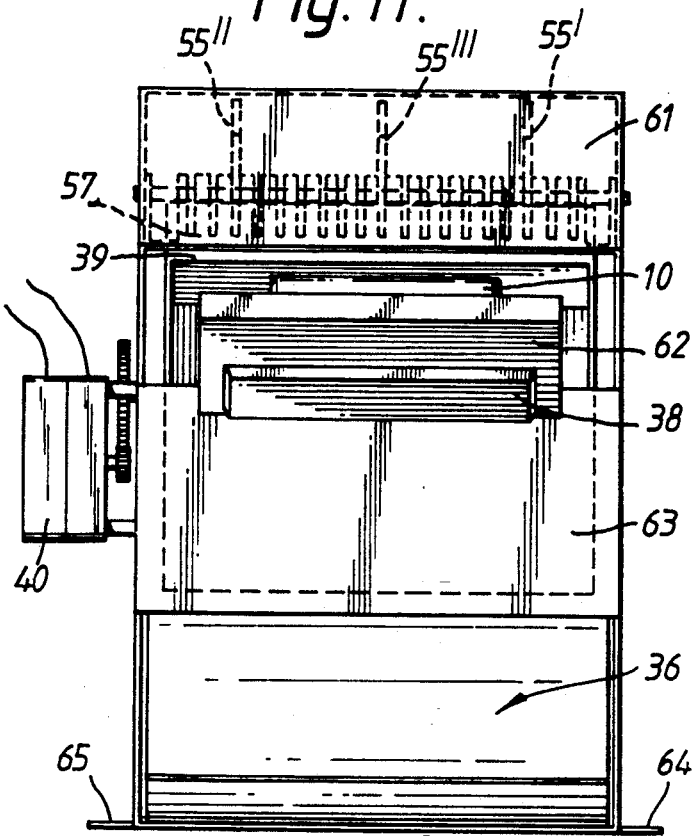
FIGS. 11 and 12 illustrate a front view of the device in FIG. 8 in the states of the device according to FIGS. 9 and 10, respectively.
Figure 12:
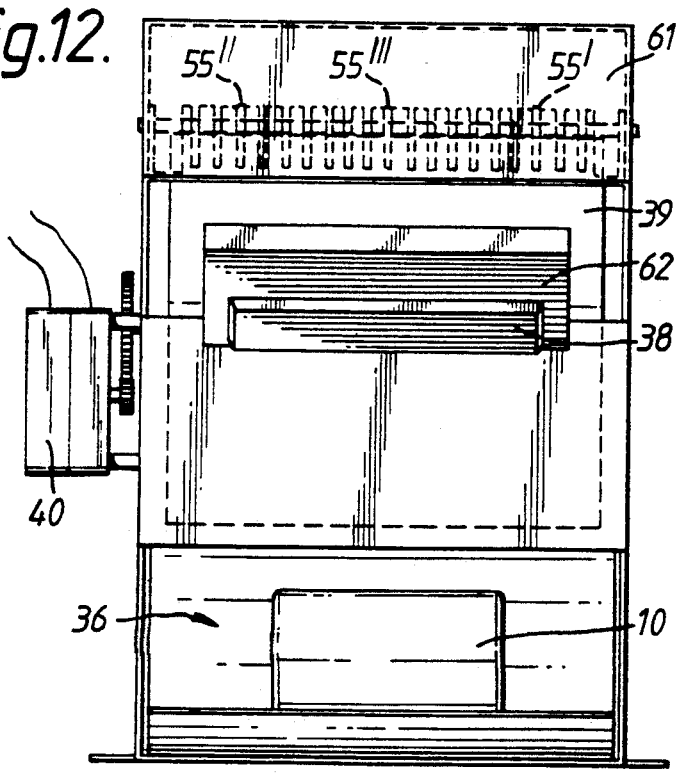

The front panels are also more clearly visible in FIGS. 11 and 12. FIG. 11 is related to the situation in FIG. 9 with the can having just entered the cradle. In FIG. 12, it is illustrated that the can 10 has been returned to the first output 36 due to the can being non-recycleable. The side members of the device according to FIGS. 8–12 are provided with side flanges 64, 65 having holes or recesses for engagement with screws (not shown), in order to be able to attach the device of FIGS. 8–12 to the base or table means 25 as shown in FIGS. 1 and 5.

At the top of FIGS. 11 and 12 there are provided two arrays of rectangular teeth coacting with the said cam members 55 in order to provide a proper positioning of said members 55 at elected locations along the length of a can to enter the cradle 41 or 42.

While the present invention has been particularly described in the context of FIGS. 1–13, an average expert in the art will readily understand that the devices according to the invention may be subjected to variations and modifications without limiting the scope of the invention as defined herein and in the attached patent claims.

Thus, the compacting device could be used with or without a device for identification and separation of beverage cans, and if used with such device, that device could be of the type disclosed in connection with FIGS. 8–12 and FIG. 13 of the present disclosure, or any other suitable type of such device, e.g. of the type disclosed in U.S. Pat. No. 4,532,859. Also, the device for identification and separation of beverage cans, e.g. of metal, as disclosed in the present specification could be used with other types of compacting devices than the device disclosed and shown in the present specification. However, in the context of the present invention, the embodiments shown and described are to be considered as preferred, but non-limitative embodiments of the invention. According to the invention, it will be seen that the compacting device is capable of operating on a continuous basis at a first cycle rate and that the device for identification and separation is capable also to operate on a continuous basis, provided that all cans received in succession are of the correct type in which case the device operates at a second cycle rate. Thus, asynchronous operation between the two devices is obtainable. Suitably the cycle rate of the compacting device is higher than the cycle rate of the device for identification and separation of the beverage cans in order to obtain such asynchronous operation.

In case synchronous operation is desirable, the control of the motor means 40 and the position of the drum cradle 41 or 42 could be linked to the operation of the detector 66 in order that a can enters the operation site 9 of the compacting device only when said site is empty and the arm means 11–13 are in retracted state. Alternatively, a separate detector means (not shown) may be located below the trap door means or operating therewith to sense when a compacted can drops through the opening 9' or the trap door retracts to cause the can to drop.

Having described our invention, we claim:

1. A device for identification and separation of beverage cans, comprising:

(a) a can input,
(b) a first can output,
(c) a second can output,
(d) means at said can input for sensing the type or types of material of said can,
(e) electric motor means,
(f) a rotary can supporting means having its axis of rotation horizontal and capable of turning in at least one direction through 360° by means of said electric motor means,
(g) said rotary can supporting means having cradle means for receiving a can at said input and retaining said can therein until delivered at the first or second can output,
(h) logic processing means capable of controlling the direction of rotation of said motor means based on an output signal from said sensing means to transfer said can either to said first can output or to said second can output,
(i) said first can output being below said can input for returning cans being of a type not to be accepted,
(j) said second can output being located approximately 180° relative to said can input and above an operation site for compacting of said can for subsequent processing thereof,
(k) can measuring means located above a path of the can from said can input to said second can output, said can measuring means capable of delivering a signal to said logic processing means for determining type and size of the can and for outputting from said processing means a signal being indicative of the can refund value, and
(l) wherein said can measuring means comprises a set of cam members capable of riding on part of the can surface as it passes said cam members to detect the diameter of said can with reference to the bottom of the cradle means holding the can.

2. A device according to claim 1, wherein said logic processing means includes motor drive moment control means to cause said rotary can supporting means to slip back in case of an overweight can to exit such can at said first can output.

3. A device according to claim 1, wherein said can measuring means is an optical detection means capable of detecting at least one of the can dimensions selected from the group consisting of diameter and length.

4. A device according to claim 1, wherein two cradle means are provided 180° apart on said rotary can supporting means.

5. A device according to claim 1, wherein said can has its ends coacting with said can measuring means by a first cam member capable of dropping to be adjacent a first end face of the can and a second cam member capable of dropping to be adjacent a second end face of the can, and means for detecting a distance between said cam members to determine an approximate length or end-to-end dimension of said can.

6. A device according to claim 1, wherein said can dimension measuring means is a capacitive detection means capable of detecting at least one of the can dimensions from the group of diameter and length.

7. A device according to claim 1, wherein said can dimension measuring means is an inductive detection means capable of detecting at least one of the can dimensions from the group of diameter and length.

8. A device for identification and separation of beverage cans, comprising:

(a) a can input,
(b) a first can output,
(c) a second can output,
(d) means at said can input for sensing the type or types of material of said can,
(e) electric motor means,
(f) a rotary can supporting means having its axis of rotation horizontal and capable of turning in at least one direction through 360° by means of said electric motor means,
(g) said rotary can supporting means having cradle means for receiving a can at said input and retaining said can therein until delivered at the first or second can output,
(h) logic processing means capable of controlling the direction of rotation of said motor means based on an output signal from said sensing means to transfer said can either to said first can output or to said second can output,
(i) said first can output being below said can input for returning cans being of a type not to be accepted,
(j) said second can output being located approximately 180° relative to said can input and above an operation site for compacting of said can for subsequent processing thereof,
(k) can measuring means located above a path of the can from said can input to said second can output, said can measuring means capable of delivering a signal to said logic processing means for determining type and size of the can and for outputting from said processing means a signal being indicative of the can refund value, and
(l) wherein said can has its ends coacting with said can measuring means by a first cam member capable of dropping to be adjacent a first end face of the can and a second cam member capable of dropping to be adjacent a second end face of the can, and means for detecting a distance between said cam members to determine an approximate length or end-to-end dimension of said can.

9. A device according to claim 8, wherein said logic processing means includes motor drive moment control means to cause said rotary can supporting means to slip back in case of an overweight can to exit such can at said first can output.

10. A device according to claim 8, wherein said can measuring means is an optical detection means capable of detecting at least one of the can dimensions selected from the group consisting of diameter and length.

11. A device according to claim 8, wherein said can dimension measuring means is a capacitive detection means capable of detecting at least one of the can dimensions selected from the group consisting of diameter and length.

12. A device according to claim 8, wherein said can dimension measuring means is an inductive detection means capable of detecting at least one of the can dimensions selected from the group consisting of diameter and length.

13. A device according to claim 8, wherein two cradle means are provided 180° apart on said rotary can supporting means.

14. A device for identification and separation of beverage cans, comprising:

(a) a can input,
(b) a first can output,
(c) a second can output,
(d) means at said can input for sensing the type or types of material of said can,
(e) electric motor means,
(f) a rotary can supporting means having its axis of rotation horizontal and capable of turning in at least one direction through 360° by means of said electric motor means,
(g) said rotary can supporting means having cradle means for receiving a can at said input and retaining said can therein until delivered at the first or second can output,
(h) logic processing means capable of controlling the direction of rotation of said motor means based on an output signal from said sensing means to transfer said can either to said first can output or to said second can output,
(i) said first can output being below said can input for returning cans being of a type not to be accepted,
(j) said second can output being located approximately 180° relative to said can input and above an operation site for compacting of said can for subsequent processing thereof,
(k) can measuring means located above a path of the can from said can input to said second can output, said can measuring means capable of delivering a signal to said logic processing means for determining type and size of the can and for outputting from said processing means a signal being indicative of the can refund value, and
(l) wherein said can dimension measuring means is a capacitive detection means capable of detecting at least one of the can dimensions selected from the group consisting of diameter and length.

15. A device according to claim 14, wherein said logic processing means includes motor drive moment control means to cause said rotary can supporting means to slip back in case of an overweight can to exit such can at said first can output.

16. A device according to claim 14, wherein two cradle means are provided 180° apart on said rotary can supporting means.

17. A device for identification and separation of beverage cans, comprising:

(a) a can input,
(b) a first can output,
(c) a second can output,
(d) means at said can input for sensing the type or types of material of said can,
(e) electric motor means,
(f) a rotary can supporting means having its axis of rotation horizontal and capable of turning in at least one direction through 360° by means of said electric motor means,
(g) said rotary can supporting means having cradle means for receiving a can at said input and retaining said can therein until delivered at the first or second can output,
(h) logic processing means capable of controlling the direction of rotation of said motor means based on an output signal from said sensing means to transfer said can either to said first can output or to said second can output,
(i) said first can output being below said can input for returning cans being of a type not to be accepted,
(j) said second can output being located approximately 180° relative to said can input and above an operation site for compacting of said can for subsequent processing thereof,
(k) can measuring means located above a path of the can from said can input to said second can output, said can measuring means capable of delivering a signal to said logic processing means for determining type and size of the can and for outputting from said processing means a signal being indicative of the can refund value, and
(l) wherein said can dimension measuring means is an inductive detection means capable of detecting at least one of the can dimensions selected from the group consisting of diameter and length.

18. A device according to claim 17, wherein said logic processing means includes motor drive moment control means to cause said rotary can supporting means to slip back in case of an overweight can to exit such can at said first can output.

19. A device according to claim 17, wherein two cradle means are provided 180° apart on said rotary can supporting means.

* * * * *